US005605169A

United States Patent [19]

Light

[11] Patent Number: 5,605,169

[45] Date of Patent: Feb. 25, 1997

[54] COLLAPSIBLE WALKER WITH A RETRACTABLE SEAT

[75] Inventor: Richard D. Light, Canoga Park, Calif.

[73] Assignee: Jenny Walker, Van Nuys, Calif.; (A California General Partnership)

[21] Appl. No.: 662,039

[22] Filed: Jun. 12, 1996

[51] Int. Cl.[6] ..... A45B 3/00

[52] U.S. Cl. ..... 135/66; 135/67; 247/5

[58] Field of Search ..... 135/66, 67, 69, 135/71, 74; 482/66, 69; 297/5–7; 280/87.021, 87.041, 87.051

[56] References Cited

U.S. PATENT DOCUMENTS

| | | | |
|---|---|---|---|
| D. 292,076 | 9/1987 | Peters | D12/130 |
| 2,792,874 | 4/1953 | Sunberg | 155/22 |
| 2,798,533 | 7/1957 | Frank | 297/6 |
| 2,960,148 | 11/1960 | Murcott | 155/22 |
| 3,442,276 | 5/1969 | Edwards et al. | 135/67 |
| 4,046,374 | 9/1977 | Breyley | 482/68 |
| 4,135,535 | 1/1979 | Thomas | 135/67 |
| 4,384,713 | 5/1983 | Deutsch et al. | 482/68 |
| 4,387,891 | 6/1983 | Knochel | 135/67 X |
| 4,643,211 | 2/1987 | Morris et al. | 135/67 |
| 4,700,730 | 10/1987 | Samuelson et al. | 135/67 |
| 4,748,994 | 6/1988 | Schultz et al. | 135/67 |
| 4,800,910 | 1/1989 | Gamm | 297/6 X |
| 4,922,405 | 5/1990 | Lewy | 135/67 |
| 5,172,715 | 12/1992 | Webb | 135/67 |
| 5,348,336 | 9/1994 | Fernie et al. | 280/641 |
| 5,371,422 | 12/1993 | Sorrell et al. | 135/66 |
| 5,417,472 | 5/1995 | Elvinsson | 297/6 |
| 5,511,571 | 4/1996 | Adrezin et al. | 135/67 X |

*Primary Examiner*—Lanna Mai

*Attorney, Agent, or Firm*—Alan R. Davis; Louis L. Dachs

[57] ABSTRACT

The invention is a walker for an invalid. In detail, the invention includes a first U shaped member having a center portion and two parallel arm portions extending downward at an acute angle and terminating in vertically extending front supports for contacting the ground. A sleeve is movably mounted on each of said arms. A détente system is included to releasably lock each of the sleeves in an intermediate position on the arm portions. A pair of generally vertical extending rear support members have first ends for contacting the ground, providing rear support, and second ends pivotally connected to the arm portions of the first U shaped member in proximity to the center portion. A pair of first links are pivotally connected by their first ends to the rear support members intermediate the ends thereof and by their second ends to the sleeves. A second generally U shaped member is included having a center portion and arm portions terminating in griping handles, with the center portion thereof pivotally connected to the center portion of the first U shaped member. A pair of vertically extending second links have their first ends pivotally connected to the arm portions of the second U shaped member intermediate the griping handles and the center portion thereof and their second ends pivotally connected to the sleeves on the arm portions of the first U shaped member. A seat is pivotally mounted to the arm portions of the second U shaped member and is movable from a position wherein the user can sit on the seat to a horizontal position for storage. The walker is collapsed for storage by moving the seat to the retracted position and releasing the sleeves and sliding them down along the arms. This will cause the first and second U shaped members to collapse toward the rear supports until they all touch.

8 Claims, 4 Drawing Sheets

FIG. 4
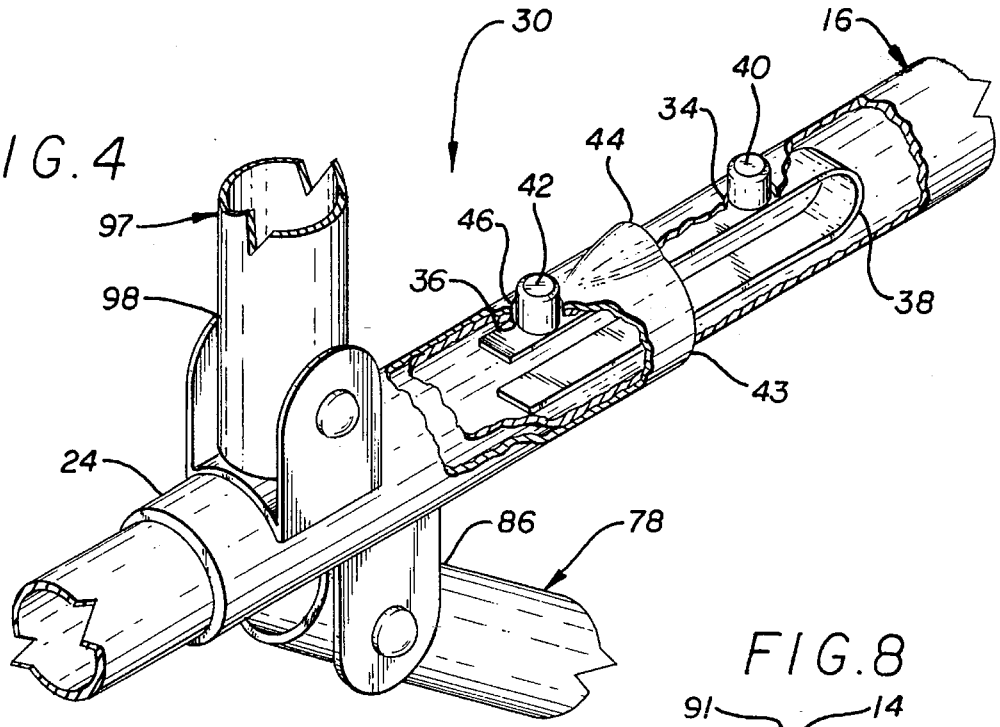
FIG. 8
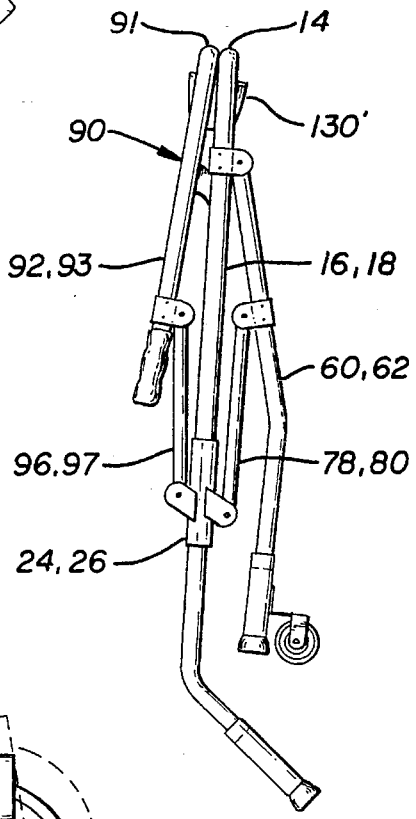
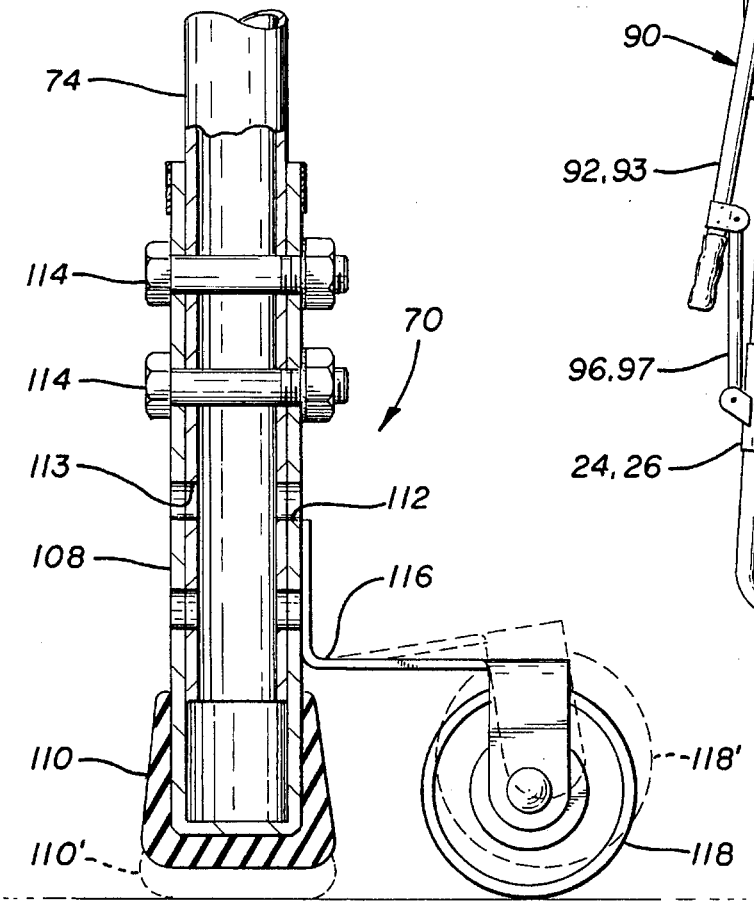
FIG. 5

COLLAPSIBLE WALKER WITH A RETRACTABLE SEAT

BACKGROUND OF THE INVENTION

1. Field of the Invention

The invention relates to the field of walkers for invalids and, in particular, to a walker that is collapsible for storage and incorporates a seat that can be easily extended for use.

2. Description of Related Art

Walking aids for the physically handicapped may be as simple as a walking stick or crutches. However, in cases where the affliction is more extensive, walkers are used. For example, U.S. Pat. No. 2,960,148, "Collapsible Invalid Walkers" by C. E. Murcott discloses a walker comprising two side frames with front and back legs that terminate in rubber pads. The person walks by grasping a pair of handles attached to the side frames, which supports and stablizes, and pushing the walker in front of him or herself. A simple sliding of the walker is all that is required. However, if the person has mobility and sufficient strength, it is possible to slightly lift the walker off the ground and move it forward, while taking a step. In U.S. Pat. No. 4,700,730 "Walker For A Small Child" by J. P Samuelson, a walker is disclosed that incorporates rollers in the front legs. This allows the invalid to lift only one end and roll the walker forward. Another example of a walker having rollers on the front legs is disclosed in U.S. Pat. No. 4,748,994 "Reversible Walker Device" by J. R. Schutz, et al. Most all of these types of walkers are collapsible for storage purposes.

U.S. Design Pat. No. 292,076 "Walker" by G. E. Peters discloses a walker having a generally U shaped frame with interconnecting support members, and with a pair wheels at the back and foot pads on the front. A seat is installed on the center of portion of the U shaped members. This allows the invalid to walk and to sit down to rest when necessary. U.S. Pat. No. 2,792,874, "Orthopedic Walker" by O. M. Sundberg discloses a walker having front and rear wheels and a foldable seat. The significant feature of this design is that the rear wheels are slidably mounted to the frame. When the invalid sits in the seat, the frame member will contract the ground, thus acting as a brake. However, this design can not be folded up for storage. U.S. Pat. No. 5,271,422 "Safety Walker" by M. R. Sorrel, et al. discloses a similar walker design.

U.S. Pat. No. 4,643,211 "Collapsible Walking Frame Having A Pivotal Seat" by T. A Morris, et al. discloses a walker having a foldable seat. The frame is built like a ladder and, therefore, is essentially a double "A" frame with cross members to provide rigidity. The A frame members are pivotally connected at the apex and an over-center linkage is used to lock the side members of the A frames apart. A foldable seat is installed between the A frames. While this walker provides a seat and is collapsible for storage, the over-center links can be easily "bumped" to an unlocked position. U.S. Pat. No. 5,348,336, "Walking Aid" by G. R. Fernie, et al discloses a four wheeled walker having a seat, which is foldable for storage. Its main feature is that it incorporates a brake system that is actuated by twisting the griping handles. While collapsible for storage, the frame design is complicated and expensive in that gear assemblies are included.

Thus, it is a primary object of the invention to provide a walker for an invalid.

It is another primary object of the invention to provide a walker for an invalid that is collapsible for storage.

It is a further object of the invention to provide a walker for an invalid that incorporates a foldable seat.

It is a still further object of the invention to provide a collapsible walker for an invalid which incorporates secure locking means that will prevent inadvertent collapse of the walker.

It is another object of the invention to provide a walker for an invalid that incorporates a foldable seat and further includes wheels on the rear supports that can be inactivated when the invalid sits in the seat.

SUMMARY OF THE INVENTION

The invention is a walker for an invalid. In detail, the invention includes a first "U" shaped member having a center portion and two parallel arms portions extending downward at an acute angle terminating in vertically extending front supports for contacting the ground. A sleeve is movably mounted on each of the arm portions of the first U shaped member. A first détente system is coupled to each of the arm portions of the first U shaped member to releasably lock the sleeves in intermediate positions between the center portion and the front supports.

A pair of generally vertical extending rear support members, in a spaced relationship, have first ends for contacting the ground, providing rear support, and second ends pivotally connected to the arms of the first U shaped member in proximity to the center portion. A pair of horizontally positioned first links, for maintaining the first U shaped member at the acute downward angle, are pivotally connected by their first ends to the rear support members intermediate the ends thereof and by their second ends to the sleeves. A second generally "U" shaped member is included having a center portion and arm portions terminating in griping handles, with the center portion thereof pivotally connected to the center portion of the first U shaped member. A pair of vertically extending second links, for maintaining the second U shaped member in a horizontal plane, are pivotally connected by their first ends to the arm portions of the second U member intermediate the griping handles and the center portion thereof, and pivotally connected by their second ends to the sleeves. In order to provide increased support a third link is coupled between the pair of rear support members between the first and second ends thereof.

A seat assembly is mounted on the walker that includes a pair of forth links having first and second ends, with the first ends pivotally connected to the arm portions of the second U shaped member between the center portion and the griping handles and by their second ends to a seat. The fourth links are rotatable from a vertical alignment so that the invalid can sit to a generally horizontal alignment toward the rear support members for storage when walking. Second détente assemblies are mounted on the arm portions of the second U shaped member for releasably securing the fourth links in the horizontal alignment position.

Preferably, wheel assemblies are mounted to the first ends of the rear support members that include a cup shaped member that is in slidable engagement with the end of the vertical member and includes a rubber pad thereon. Both the cup shaped member and the end of the vertical member incorporate a plurality of alienable holes and fastener assemblies inserted therethrough to control height. Coupled to the cup shaped member is a leaf spring which supports a wheel. The spring is positioned on the cup shaped member such that the wheel extends beyond the rubber pad. However, any weight put on the walker will force the wheel to move upward allowing the pad to touch the ground.

In operation, the user walks by standing between the arm portions of the first and second U shaped members facing toward the front, griping the handles on the second U shaped member, and slightly lifting the handles upward. This causes the walker to rotate about the rear wheels, lifting the ends off the arms of the first U shaped member off the ground. The user can then take a step or two. If so desired, the walker can be moved without lifting the legs off the ground by dragging it there along. When the user wishes to rest, the seat can be moved from its stored or horizontally retracted position to a vertical position by just pushing the seat downward, overcoming the resistance of the second détentes. When the user sits down in the seat, the second ends of the vertical support members will move downward compressing the spring in the wheel assemblies causing the rubber pad on the end of the cup shaped member to touch the ground. This will prevent the walker from moving when the user is in the seated position.

For storage, one need only retract the seat, and release the first détentes mounted on the arm portions of the first U shaped member, which will release the sleeves. The sleeves are moved down the arm portions of the first U shaped member allowing the pairs of first and second links to rotate simultaneously about their first and second ends. This causes simultaneous rotation of the second U shaped member about its center portion so that arms thereof become parallel with the arms of the first U shaped member and rotation of the vertical supports about their first ends toward the arms of the first U shaped member until they all contact each other.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

FIG. 4 is an enlarged partial cross-sectional perspective view of a portion of FIG. 1 encircled by the arrow 4.

FIG. 5 is an enlarged partial cross-section view of a portion of the walker shown in FIG. 1 taken along the line 5—5.

FIG. 8 is a side view similar to FIG. 7 with the walker totally collapsed.

DESCRIPTION OF THE PREFERRED EMBODIMENT

Figure 1:
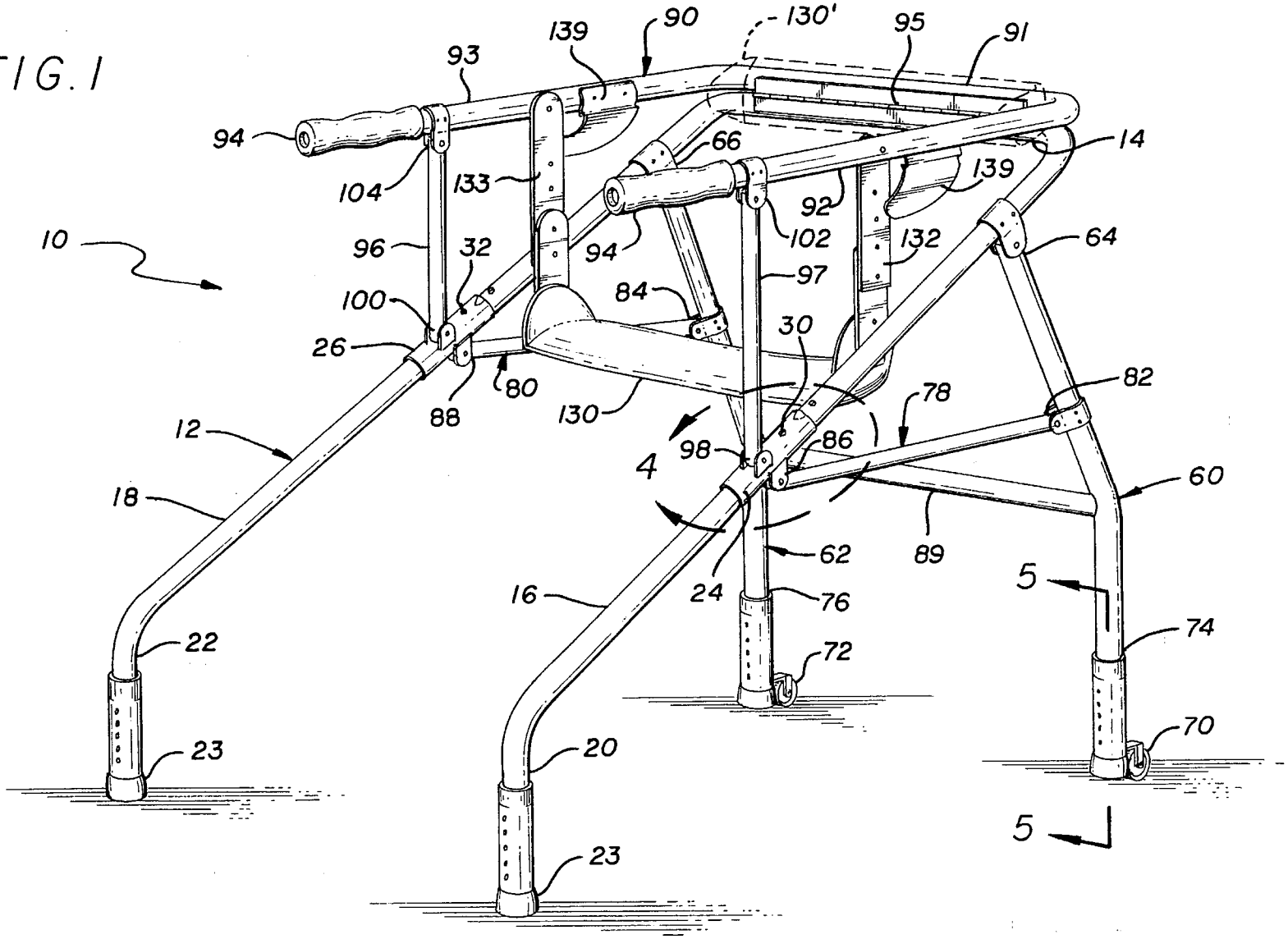
FIG. 1 is a perspective view of the walker.
Figure 2:
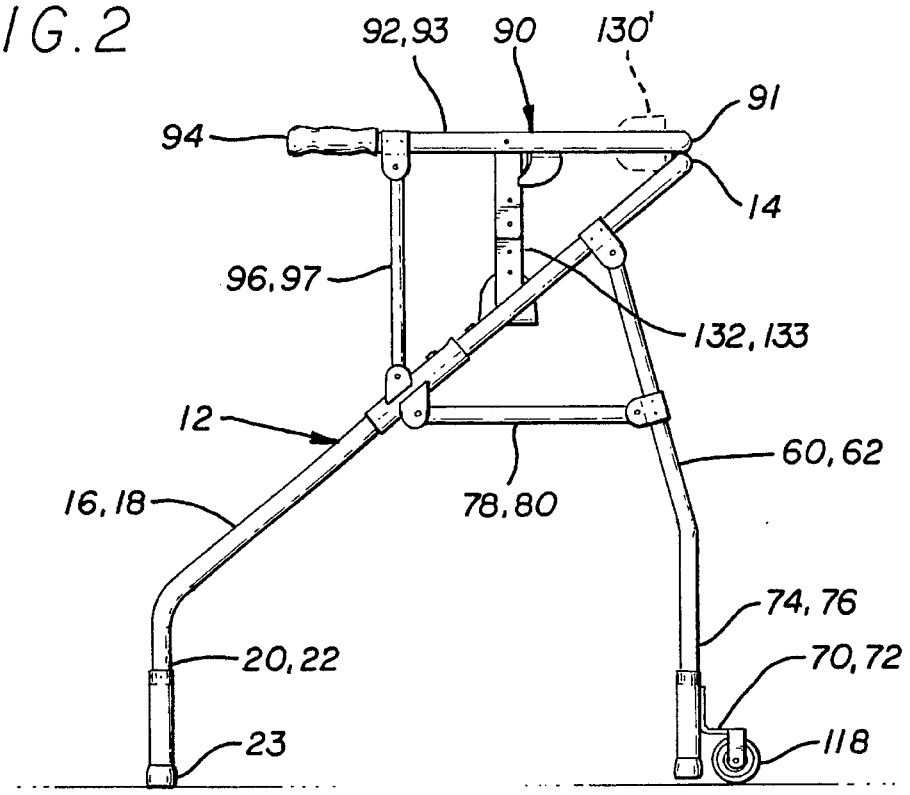
FIG. 2 is a side view of the walker.
Figure 3:
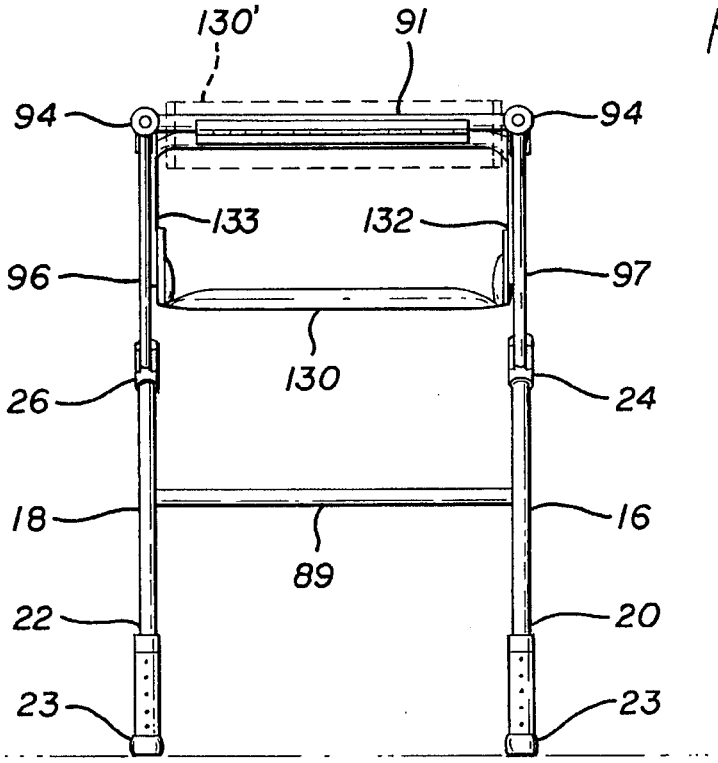
FIG. 3 is a is front view of the walker.

Referring to FIGS. 1–4, the walker is generally indicated by numeral 10. The walker 10 includes a first "U" shaped member 12 having a center portion 14 and side arm portions 16 and 18, and is made of rigid hollow tubular material. Each of the arms 16 and 18 terminate in vertical legs 20 and 22 having adjustable length end caps 23.

A pair of sleeves 24 and 26 are slidably mounted on the side arms 16 and 18 and are held in a location generally midway between the center portion 14 and vertical legs 20 and 22 by détente assemblies, generally indicated by numerals 30 and 32. Referring to FIG. 4, the détente assembly 30 includes a pair of holes 34 and 36 in series on the arm portion 16. A "U" shaped spring clip 38 is installed in the interior of the arm portion 16 having two buttons 40 and 42 that extend out of the holes 34 and 36, respectively. Note that the button 40 holds the spring clip 38 in place, and additionally, will retract the button 42 when depressed. However, button 40 always remains engaged wiht hole 34. The end 43 of the sleeve 24 includes a button guide way 44 and a hole 46. With the walker 10 in the condition shown in FIGS. 1–3, the hole 36 is aligned with the hole 46 in the sleeve 24 such that the button 42 extends into the hole 46 locking the sleeves 24 in place along with arm portion 16. The d étente assembly 32 is identical in construction and operation. To release the sleeve 24, one need only press on the button 40 causing the button 42 to disengage from the hole 46. Thereafter, the sleeve 24 can be slide down the arm 16. Of course, there are numerous other types of quick release détentes that can be used.

Referring back to FIGS. 1–3, a pair of rear vertical rear supports 60 and 62 are pivotally coupled by their upper ends 64 and 66, respectively, to the arms 16 and 18 of the first U shaped member 12 in proximity to the center portion 14 and terminate in wheel assemblies 70 and 72 at their lower ends 74 and 76. A pair of generally horizontal links 78 and 80 are pivotally coupled by their first ends 82 and 84 to the vertical rear supports 60 and 62 at an intermediate point between the first and second ends and by their second ends 86 and 88 to the sleeves 24 and 26, respectively. A horizontal link 89 is rigidly attached at an intermediate point between the ends of the rear supports 60 and 62.

A second U shaped member 90 having a center portion 91 and arms 92 and 93 terminating in hand grips 94 is pivotally coupled by its center portion 91 to the center portion 14 of the first U shaped member 12 by means of a piano type hinge 95. A pair of vertically extending second links 96 and 97 are pivotally coupled by their first ends 98 and 100 to the sleeves 24 and 26, respectively, mounted on the arms 16 and 18 and by their second ends 102 and 104 to the arms 92 and 93 at an intermediate point between the center portion 91 and hand grips 94.

Referring to FIG. 5 it can be seen that the wheel assembly 70 is adjustable in height. A cup shaped member 108 is in slidable engagement with the end 74 of the vertical member 60 and has a rubber pad 110 thereon. Both the cup shaped member 108 and end 74 incorporate a plurality of alignable holes 112 and 113, respectively. Fastener assemblies 114 inserted through the aligned holes 112 and 113 fasten the two together; height adjustment being accomplished by realignment of the holes. Coupled to the cup shaped member 108 is a leaf spring 116 which supports a wheel 118. The spring 116 is positioned on the cup shaped member 108 such that the wheel 118 extends beyond the rubber pad 110. However, any weight put on the walker will force the spring 116 to deflect moving the wheel 118 upward allowing the pad 110 to touch the ground (with the wheel shown in dotted lines and indicated by numeral 118' and the pad indicated by numeral 110'). Wheel assembly 72 operates in a similar manner. The caps 23 on the vertical legs 20 and 22 of the arm portions 16 and 18 of the first U shaped member 12 are similarly adjustable in length.

Figure 6:
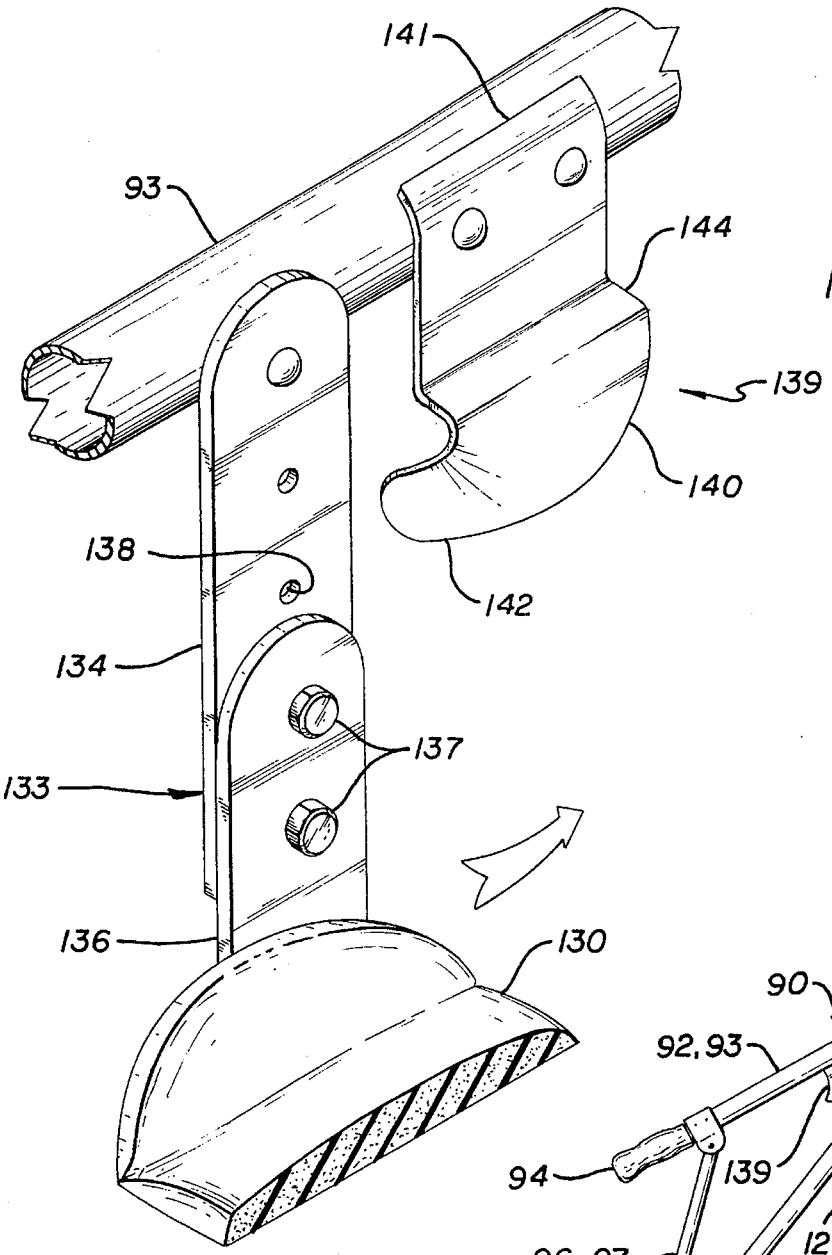
FIG. 6 is an enlarged partial view of the walker shown in FIG. 1 illustrating the détente system for storing the seat.
Figure 7:
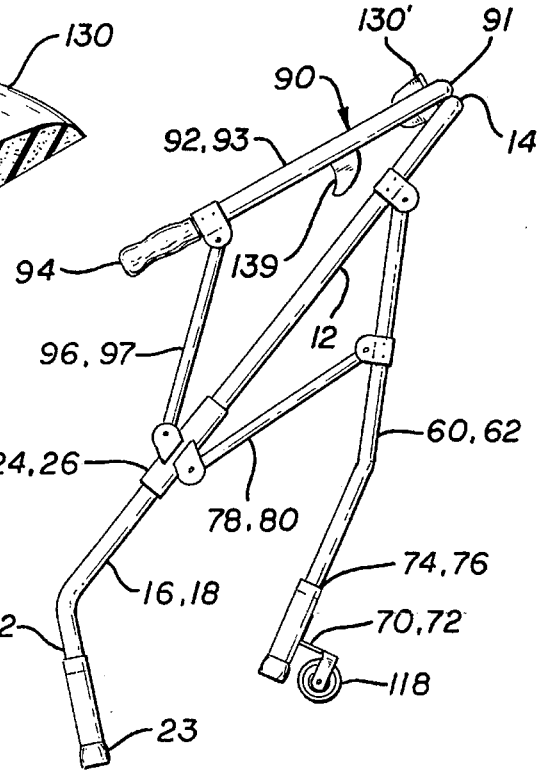
FIG. 7 is a side view similar to the side view shown in FIG. 2 with the walker partially collapsed.

Still referring back to FIGS. 1–3 and additionally to FIG. 6, it can be seen that a retractable seat 130 is suspended from the arms 92 and 93 of the second U shaped member 90 by means of adjustable length links 132 and 133 rotatably attached thereto. Particularly referring to FIG. 6, the link 133 has upper and lower portions 134 and 136 joined together by a plurality of fastener assemblies 137 extending through holes 138. Link 132 is similar in design. Thus the seat's 130 height is adjusted by varying the over-lap of the upper and lower portions 134 and 136 of the links 132 and 133. A d étente 139 is provided includes a metal plate 140 fastened at its top end 141 to the arm 93. The lower end 142 is slanted toward the link 133 and the middle portion is bent to form a shelf 144. The seat 130 is stored by rotating it back and upward so that the link 133 rides up the slanted end 142 causing the metal plate 140 to spring out of the way. Upon the link 133 clearing the shelf 144, the plate snaps back locking the link thereon and seat 130 in the retracted position, indicated by numeral 130'. To release the seat, one need only push the seat 130 downward over riding the d étente 139 and it will drop back down. A second détente also indicated by 139 can be mounted in a similar manner on arm 92, providing redundancy. Again, it should be pointed out that there are numerous other types of détentes that can be used.

In operation, the user walks by standing facing forward between the arm portions 16 and 18, and 92 and 93 of the first and second U shaped members 12 and 90, respectively, griping the handles 94 on the second U shaped member, and slightly lifting the walker upward from the front end. This causes the walker 10 to rotate about the rear wheels 118, lifting the ends 20 and 22 of the arm portions 16 and 18 of the first U shaped member 12 off the ground. The user can then take a step or two. If so desired, the walker 10 can be moved without lifting the ends 20 and 22 off the ground by just dragging it along the floor. When the user wishes to rest, the seat 130 can be moved from its stored or horizontally retracted position 130' to a vertical position by just pushing the seat downward, overcoming the resistance of the d étente 139. When the user sits down in the seat 130, the second ends 74 and 76 of the vertical support members 60 and 62 will move downward overcoming the resistance of the spring 116 allowing the rubber pad 110 of member 108 to touch the ground. This will prevent the walker 10 from moving when the user is in the sitting position.

Referring to FIGS. 1–4, 7 and 8, for storage, one need only retract the seat 130 by pushing it backward such that it rotates upward (indicated by numeral 130') and becomes locked by the détentes 139. Release of the détentes 30 and 32 are accomplished by depressing the buttons 40 causing button 42 to leave the hole 46 allowing the sleeves 24 and 26 to slide down the arm portions 16 and 18. This will, in turn, cause both the first links 78 and 80 and second links 96 and 97 to rotate about their ends and, additionally, cause the first U shaped member 12 to rotate toward the vertical support members 60 and 62 along with the second U shaped member 90 until they all contact each other. To expand the walker 10, one need only reverse the process. The sleeves 24 and 26 are slid upward along the arms 16 and 18 until the buttons 42 again become locked in holes 46. Note that button 42 will automatically be depressed as it enters guide way 44.

While the invention has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

INDUSTRIAL APPLICABILITY

The invention has applicability to the medical appliance industry.

I claim:

1. A walker for an invalid comprising:

a first U shaped member having a center portion and two parallel arm portions extending downward at an acute angle terminating in vertically extending front supports for contacting the ground;

a sleeve slidably mounted on each of said arm portions of said first U shaped member;

means to releasably lock said sleeve at an intermediate position on each of said arm portions;

a pair of generally vertical extending rear support members in a spaced relationship having first ends for contacting the ground providing rear support and second ends pivotally connected to the upper portions of said arm portions of said first U shaped member in proximity to said center portion;

a pair of first links pivotally connected by their first ends to said rear support members intermediate the ends thereof and by their second ends to said sleeves on each of said arm portions of said first U shaped member;

a second generally U shaped member having a center portion and arm portions terminating in gripping handles, said center portion of said second U shaped member pivotally connected to said center portion of said first U shaped member; and a pair of second links having first and second ends, said first ends pivotally connected to said arm portions of said second U shaped member intermediate said gripping handles and said center portion thereof and by said second ends to said sleeves on said first U shaped member.

2. The walker as set forth in claim 1 including a third link coupled between said pair of rear support members between said first and second ends thereof.

3. The walker as set forth in claim 1, or 2 including a seat assembly comprising:

a pair of third links having first and second ends, the first ends of the third links pivotally connected to said arms of said second U shaped member between said center portion and said second ends of said second links, said third links rotatable from a vertical alignment to a generally horizontal alignment;

a seat coupled to said second ends of said third links; and second means to releasably secure said third links in said horizontal alignment.

4. The walker as set forth in claim 3 wherein said second links extend vertically upward.

5. The walker as set forth in claim 4 wherein said center portions of said first and second U shaped members are joined together by means of a piano hinge.

6. The walker as set forth in claim 5 wherein the length of said first ends of said rear support members are adjustable.

7. The walker as set forth in claim 6 wherein the length of said vertical ends of said arm portions of said first U shaped member are adjustable in length.

8. The walker as set forth in claim 7 wherein wheel assemblies are mounted to said first ends of said rear support members, said wheel assemblies comprising:

a cup shaped members slidably mounted over the said ends of said rear support members, the bottoms of said cup shaped members having elastic pads;

fastening means to adjust the position of said cup shaped member on said second end of said shaft; and wheel assemblies attached to said cup shaped member comprising:

a leaf spring mounted on said cup shaped member; and a wheel rotatably mounted to said leaf spring.

* * * * *